US006135802A

United States Patent [19]

Nakamura

[11] Patent Number: 6,135,802

[45] Date of Patent: Oct. 24, 2000

[54] COVER-EQUIPPED CONNECTOR

[75] Inventor: Hideto Nakamura, Yokkaichi, Japan

[73] Assignee: Sumitomo Wiring Systems, Ltd., Japan

[21] Appl. No.: 09/219,401

[22] Filed: Dec. 23, 1998

[30] Foreign Application Priority Data

Dec. 25, 1997 [JP] Japan ..... 9-356971

[51] Int. Cl.[7] ..... H01R 13/627

[52] U.S. Cl. ..... 439/352; 439/138

[58] Field of Search ..... 439/352, 357, 439/489, 350, 358, 372, 488, 138

[56] References Cited

U.S. PATENT DOCUMENTS

| | | | |
|---|---|---|---|
| 4,884,978 | 12/1989 | Inaba et al. | 439/352 |
| 5,437,559 | 8/1995 | Okumura et al. | 439/310 |
| 5,480,324 | 1/1996 | Maegawa et al. | 439/489 |
| 6,019,629 | 2/2000 | Ito et al. | 439/489 |

FOREIGN PATENT DOCUMENTS

| | | |
|---|---|---|
| 0 067 730 | of 1982 | European Pat. Off. . |
| 0 356 157 | of 1990 | European Pat. Off. . |
| 0 637 102 | of 1995 | European Pat. Off. . |
| 0 789 425 | of 1997 | European Pat. Off. . |
| 64-51276 | of 1989 | Japan . |

*Primary Examiner*—Neil Abrams
*Assistant Examiner*—Eugene G. Byrd
*Attorney, Agent, or Firm*—Anthony J. Casella; Gerald E. Hespos; Michael J. Porco

[57] ABSTRACT

A compact pair of electrical connectors are provided with a cover that os automatically openable. The connectors include housings (1, 21). When the connection of the housings (1, 21) is started, a pushed-up portion (61) is moved along a guide surface (65) of a push-up plate (64), thereby gradually opening a cover (51), and then is moved onto a lock arm (15). The lock arm (15) is elastically deformed upward by lock projections (17) moving onto locking projections (46) and the cover (51) is further opened according to this elastic deformation. When the lock arm (15) is elastically deformed to its maximum degree, a push-in portion (16) is lifted to a position immediately before upper beams (18A) of a jam preventing frame (18) and the pushed-up portion (61) is moved upward along tapered surfaces (68) of the upper beams (18A), moving over the upper beams (18A). When the housings (1, 21) are properly connected, the lock arm (15) is restored to its original shape and the cover (51) is closed by the biasing force of the biasing spring (57).

17 Claims, 8 Drawing Sheets

COVER-EQUIPPED CONNECTOR

BACKGROUND OF THE INVENTION

1. Field of the Invention

The present invention relates to a cover-equipped connector.

2. Description of the Prior Art

Prior art electrical connectors comprise a female housing that is insertable into a receptacle of a male housing. A lock arm is provided on the prior art female housing for elastic locking with the male housing. In recent years, it has become an urgent necessity to prevent an erroneous unlocking by inadvertent contact of another member with the lock arm. Such an erroneous unlocking could lead to the entrance of external matter into the receptacle of a connector provided in an essential circuit, particularly an airbag circuit.

To address this need, it recently was proposed to provide the male housing with a cover for openably and closably covering a lock portion over the front surface of the receptacle. However, the cover of this proposed connector proposed would have to be opened by hand before the housings are connected. This leads to an increase in the number of operation steps. Furthermore, it takes time to open the cover when the connector is arranged in a narrow space, thereby presenting a problem in operation efficiency. Thus, there is still an opportunity for improvements.

The present invention was developed in view of the above problem and an object thereof is to provide a cover-equipped connector in which housings can smoothly be connected.

SUMMARY OF THE INVENTION

According to the invention, there is provided a cover-equipped connector. The connector includes a cover having a function of substantially covering a locking mechanism for locking at least one pair of housings to be connected with each other. The cover is openably and closably provided on the first housing. The second housing is provided with an elastic member which is elastically deformable or displaceable as the two housings are connected. The elastic member comprises at least one opening portion for engaging the cover to substantially displace it in an opening direction.

According to a preferred embodiment, there is provided a cover-equipped connector with a cover which has a function of covering a locking mechanism for locking a pair of housings to be connected with each other. The cover is openably and closably provided on one of the housings. The other housing is provided with an elastic member which is elastically deformable as the two housings are connected. The elastic member comprises an opening portion for engaging the cover to displace it in an opening direction.

While the two housings are connected, the elastic member is elastically deformed and the opening portion provided on this elastic member pushes the cover, thereby opening it. Operability is good since the cover can be opened as the housings are connected. Further, the elastic member does not undergo an elastic deformation before the connection of the housings is started. In other words, the elastic member is retracted in the housing. Thus, the housing having the elastic member can be compact before the connection of the housings.

Preferably, the locking mechanism comprises one or more locking projections provided on the first housing for interacting with the elastic member. The locking projections are configured to deform the elastic member in the opening direction of the cover when the first and second housings are mated. Accordingly, the cover may be displaced in the opening direction by the interaction of the elastic member with the locking projections upon the mating of the housings.

Preferably, the elastic member is a lock arm which forms at least a part of the locking mechanism. Accordingly, the connector is allowed to have a simpler construction since the lock arm is used also as the elastic member.

A jam preventing portion preferably is provided substantially for preventing wires from getting jammed by the elastic member, and preferably by the lock arm that is provided on the second or other housing. The jam preventing portion may be formed on the second or other housing, and preferably is provided in a rear position thereof. The cover is openable to a position where it is beyond the jam preventing portion when the elastic member, preferably the lock arm, is deformed elastically.

As the housings are connected, the cover is gradually opened as the lock arm is elastically deformed and then moved beyond the jam preventing portion. Even if the jam preventing portion is aligned normal to the mating direction, the housings can be connected without opening the cover by hand.

It is further preferred that a portion of the elastic member, preferably the lock arm comes into contact with the jam preventing portion when it is deflected substantially to its maximum extent. Accordingly, the cover may be guided or passed from the elastic member, preferably the lock arm, to the jam preventing portion upon a further mating of the housings.

The jam preventing portion preferably is provided with a tapered portion for further guiding or pushing the cover in the opening direction upon the mating of the first and second housings.

According to a further preferred embodiment, the opening portion comprises a push-up portion for engaging the cover at an initial stage of the connection of the housings, thereby opening the cover in the opening direction so that the cover can be transferred onto the elastic member, preferably the lock arm. The push-up portion may be provided in a front position of the elastic member, preferably the lock arm provided on the second or other housing.

After the connection of the housings is started, the cover is first opened by the push-up portion, and then transferred onto the lock arm. Subsequently, the cover is opened further as the lock arm undergoes an elastic deformation, and consequently moved beyond the jam preventing portion. Thus, the housings can be connected while the cover is automatically opened continuously from the beginning to the end.

Preferably, the cover-equipped connector further comprises a rejecting means for disconnecting the housings when they are substantially insufficiently mated and released in this position. Accordingly, the connector housings cannot remain in the only partly connected state thus revealing an incorrect or incomplete mating of the housings.

Further preferably, the rejecting means comprises a push-in member which is pushed into the housing by the elastic member, preferably the lock arm substantially upon the mating of the housings.

Still further preferably, the cover comprises a pushed-up portion which is pushed up by the elastic member, preferably the lock arm, wherein the pushed-up portion comprises at least one tapered portion. Accordingly, the cover can be opened smoothly in the opening direction by the sliding movement of its tapered portion on the elastic member and/or jam preventing portion.

These and other objects, features and advantages of the present invention will become more apparent upon a reading of the following detailed description and accompanying drawings.

DETAILED DESCRIPTION OF THE PREFERRED EMBODIMENTS

Hereafter, one embodiment of the invention is described with reference to FIGS. 1 to 8.

Figure 1:
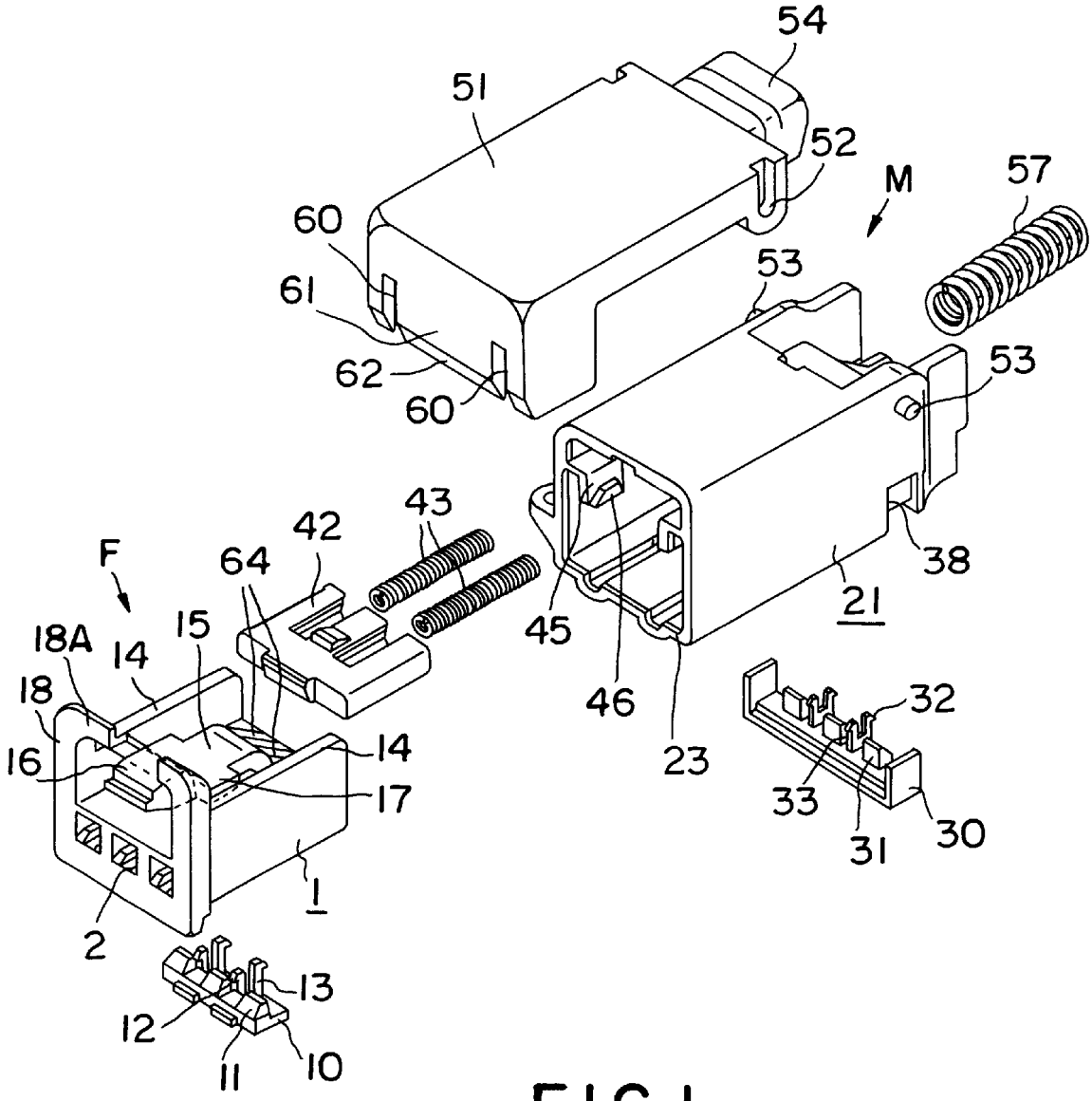
FIG. 1 is an exploded perspective view of one embodiment of the invention.
Figure 2:
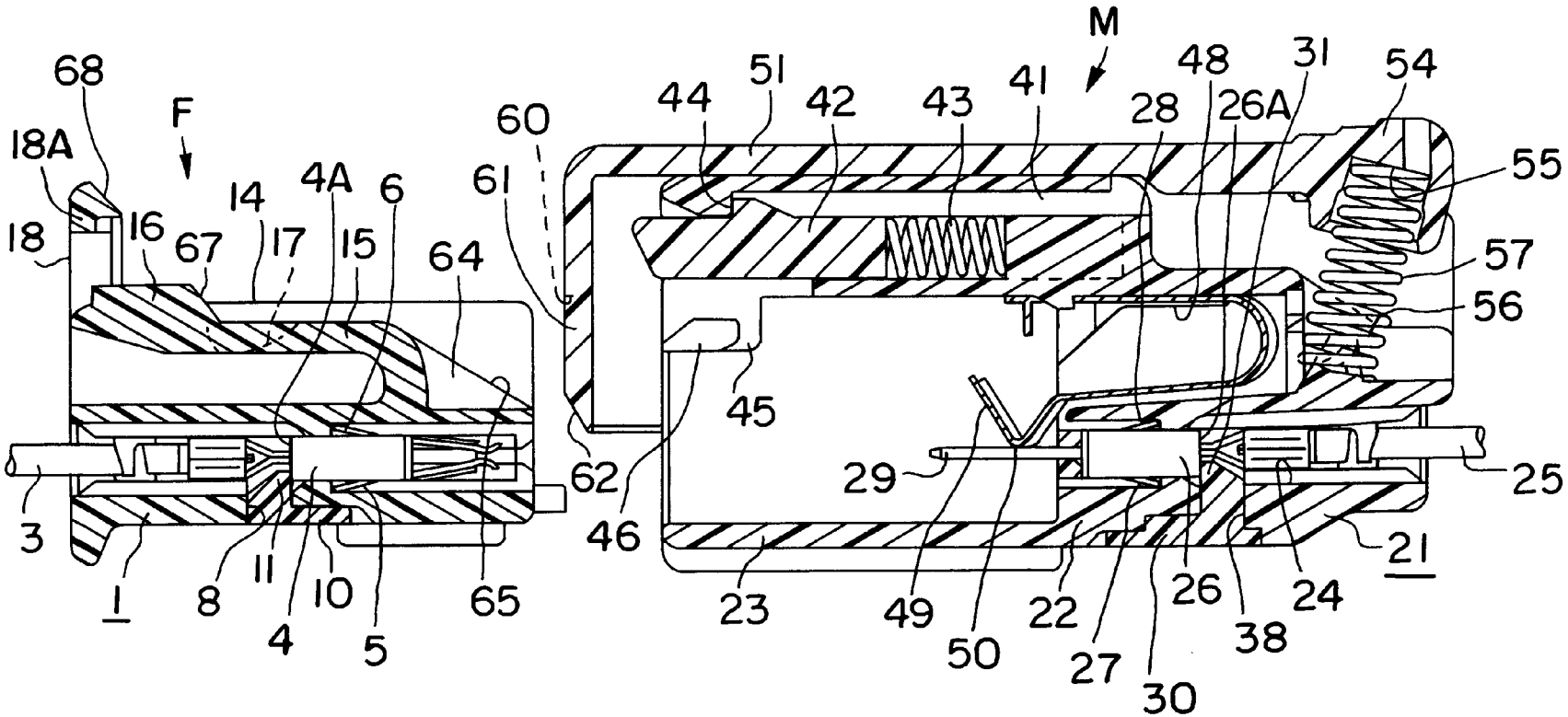
FIG. 2 is a vertical section of the embodiment before two connectors are connected.

This embodiment is, as shown in FIGS. 1 and 2, comprised of a female connector F and a male connector M to be connected with each other. In the following description, a side of a connector to be connected with a mating connector is referred to as a front side for both connectors F and M.

The female connector F includes a female housing 1 substantially in the form of a block made e.g. of a synthetic resin. As shown in FIG. 1, three cavities 2 are formed substantially side by side in the female housing 1. Female terminal fittings 4 each having a wire 3 connected with its end are inserted or insertable into the respective cavities 2 preferably from behind, as shown in FIG. 2. Metal engaging portions 5 are engaged with locking steps 6 formed in the cavities 2, thereby effecting primary locking to prevent the female terminal fittings 4 from coming out.

In the lateral, preferably lower surface of the female housing 1 is formed a retainer mount hole 8, in which a retainer 10 is mountable at an angle different from 0° or 180°, preferably substantially normal with respect to the terminal fitting 4. The retainer 10 is formed with engaging projections 11 engageable with jaw portions 4A formed on the female terminal fittings 4. The retainer 10 initially is held in its partial lock position by partial lock portions 12. In this state, since the engaging projections 11 are located in retracted positions below or positions at a distance to the bottom surfaces of the cavities 2, the insertion of the female terminal fittings 4 is enabled. After the insertion of the female terminal fittings 4, the retainer 10 is pushed or pushable to its full lock position where it is held by full lock portions 13. Then, the engaging projections 11 substantially project into the cavities 2 to engage the rear surfaces of the jaw portions 4A of the female terminal fittings 4. As a result, the female terminal fittings 4 are doubly locked so as not to come out.

Protection walls 14 stand along lateral, preferably left and right side edges of the upper surface of the female housing 1. In a position between the protection walls 14 is formed an elastically deformable lock arm 15 which substantially extends from a front side and is folded backward. The leading end of the lock arm 15 reaches the rear surface of the female housing 1, and has a push-in portion 16 raised on the upper surface thereof. A pair of lock projections 17 bulge out at the opposite side edges slightly before the push-in portion 16.

At the rear end of the upper surface of the female housing 1 is formed a substantially gate-shaped jam preventing frame 18 in such a manner as to substantially surround the leading end of the lock arm 15. This jam preventing frame 18 has a function of preventing wires from getting jammed between the upper surface of the female housing 1 and the lock arm 15.

The male connector M includes a male housing 21 made e.g. of a synthetic resin. A receptacle 23 into which the female housing 1 is fittable is formed in the front surface of a main body 22. Similar or corresponding to the female connector F, three cavities 24 are formed substantially side by side in the main body 22, and male terminal fittings 26 connected with ends of wires 25 are inserted or insertable into the respective cavities 24 from behind. The male terminal fittings 26 are or can be accommodated lockingly in the cavities 24 with tabs 29 projecting into the receptacle 23 by metal locking portions 27 engaging locking steps or projections 28 formed in the cavities 24.

In the lateral, preferably lower surface of the male housing 21 is formed a retainer mount hole 38, in which a retainer 30 is mountable. The retainer 30 is formed with engaging projections 31 that are engageable with jaw portions 26A formed on the male terminal fittings 26. The retainer 30 initially is held in its partial lock position by partial lock portions 32. In this state, since the engaging projections 31 are located in retracted positions below or spaced apart positions from the bottom surfaces of the cavities 24, the insertion of the female terminal fittings 24 is enabled. After the insertion of the female terminal fittings 26, the retainer 30 is substantially pushed to its full lock position where it is substantially held by full lock portions 33. Then, the engaging projections 31 substantially project into the cavities 24 to engage the rear surfaces or surfaces on the extraction side of the jaw portions 26A of the male terminal fittings 26. As a result, the female terminal fittings 26 are doubly locked so as not to come out.

At the ceiling or lateral side of the receptacle 23 is formed an accommodation chamber 41 which is open in the front surface, and a pushed-in member 42 is slidably fitted or fittable in this accommodation chamber 41 with respect to forward and backward directions. The pushed-in member 42 is to be pushed by the push-in portion 16 of the lock arm 15 provided on the female housing 1, and is biased in a direction of the female housing 1, preferably substantially forward by e.g. two return springs 43 made e.g. of compression coil springs provided at a rear surface side. The movement of the pushed-in member 42 is stopped by a locking portion 44 provided on the ceiling surface. A front end portion of the bottom wall of the accommodation chamber 41 is substantially open, and locking projections 46 are formed on the inner surfaces of walls 45 suspended from the opposite side edges or walls. The lock projections 17 of the lock arm 15 move over the locking projections 46 to be engaged or engageable with the rear surface thereof.

A shorting terminal 48 is mounted in a space at a side, preferably substantially above the cavities 24 in the main body 22. The shorting terminal 48 is formed e.g. by bending a conductive metal plate so as to have a substantially U-shaped cross section, and is mounted with its upper part secured and a bend portion directed backward. A lower part of the shorting terminal 48 is branched e.g. into three branch portions 49 so as to conform or correspond to the number of male terminal fittings 26 to be accommodated. Contact portions 50 preferably triangularly bent to point downward are formed at the leading ends of the respective branch portions 49. In a mounted state of the shorting terminal 48, the contact portions 50 of the branch portions 49 are or can be in contact with the corresponding tabs 29 projecting into the receptacle 23, thereby establishing an electrical connection between the respective male terminal fittings 26. This prevents an occurrence of a potential difference between the male terminal fittings 26. On the other hand, when the housings 1, 21 are connected, the respective branch portions 49 are elastically pushed up or deflected by the female housing 1 to be separated from the tabs 29, with the result that the respective male terminal fittings 26 are electrically disconnected from each other (see FIG. 8).

A cover 51 for substantially protecting the lock portions of the housings 1, 21 by substantially covering them is mounted on the male housing 21. Specifically, this cover 51 covers the entire front surface and the parts of the lateral, preferably left and right surfaces of the male housing 21, i.e. portions of the opposite side surfaces from the front of the upper end of the receptacle up to a position slightly backward therefrom. This cover 51 is supported so as to be freely rotatably or pivotal e.g. by fitting bearing holes 52 formed at the left and right side edges of the rear end thereof on pins 53 projecting from the male housing 21. An operable portion 54 is formed at the rear end of the cover 51. As shown in FIG. 2, a biasing spring 57 made of e.g. a compression coil spring is mounted or mountable between a spring receiving portion 55 provided in the rear surface of the operable portion 54 and a spring receiving portion 56 provided in the upper surface of the main body 22. Normally, a counterclockwise rotational force in FIG. 2 is given to the cover 51 by the elasticity of the biasing spring 57, and the cover 51 is held substantially closed upon being brought into contact with the upper surface of the male housing 21. The cover 51 is manually openable by pushing the operable portion 54.

In this embodiment, the housings 1, 21 can be connected while the cover 51 in its closed position is opened substantially automatically. Hereafter, a construction for substantially automatically opening the cover 51 is described.

Figure 3:
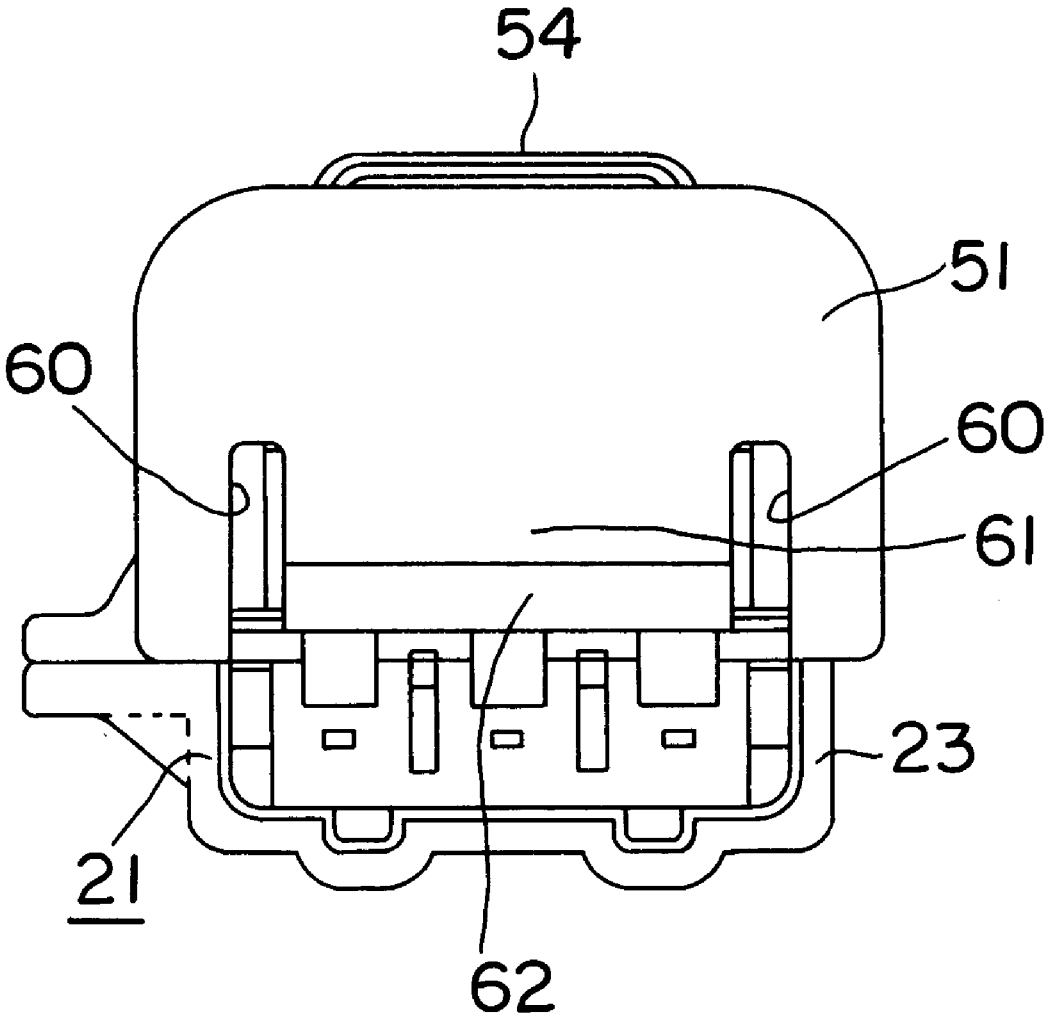
FIG. 3 is a front view of a male housing.

At the lateral, preferably left and right ends of the front surface of the cover 51, slits are made from the bottom edge to a substantially middle position (or a position substantially corresponding or conforming the height of the protection walls 14) with respect to height direction as shown in FIG. 3, thereby forming a pair of escape grooves 60 for substantially avoiding the interference with the protection walls 14 of the female housing 1. A portion between the escape grooves 60 acts as a pushed-up portion 61, and a bottom edge of the front surface thereof is formed into a tapered surface 62. On the other hand, a pair of push-up plates or portions 64 are formed in positions before or at the front end with respect to the lock arm 15 on the upper surface of the female housing 1. The upper surface of the push-up plate 64 acts as a guide surface 65 which is inclined upward from the front edge position of the upper surface of the female housing 1 toward the back, and the rear end of the guide surface 65 substantially reaches the height of the upper surface of a base portion of the lock arm 15.

The push-in portion 16 provided at the leading end of the lock arm 15 preferably has a pushing surface 67 (right surface in FIG. 2) which is inclined upward. An opposite surface of the push-in portion 16 is located near the leading end of the lock arm 15. As described later, when the lock arm 15 is elastically deformed in a deflection direction, preferably substantially upward to its maximum degree, the rear end of the push-in portion 16 is lifted to a position immediately before or at upper beams 18A of the jam preventing frame 18. The front surfaces of the upper beams 18A of the jam preventing frame 18 are formed into tapered surfaces 68.

This embodiment is constructed as described above, and the action thereof is described herebelow. The male and female terminal fittings 4, 26 are respectively inserted into the housings 1, 21 and doubly locked by the retainers 10, 30. In the male housing 21, the cover 51 is mounted in its substantially closed state. The housings 1, 21 in this state are placed substantially opposite or aligned to each other and connected.

Figure 4:
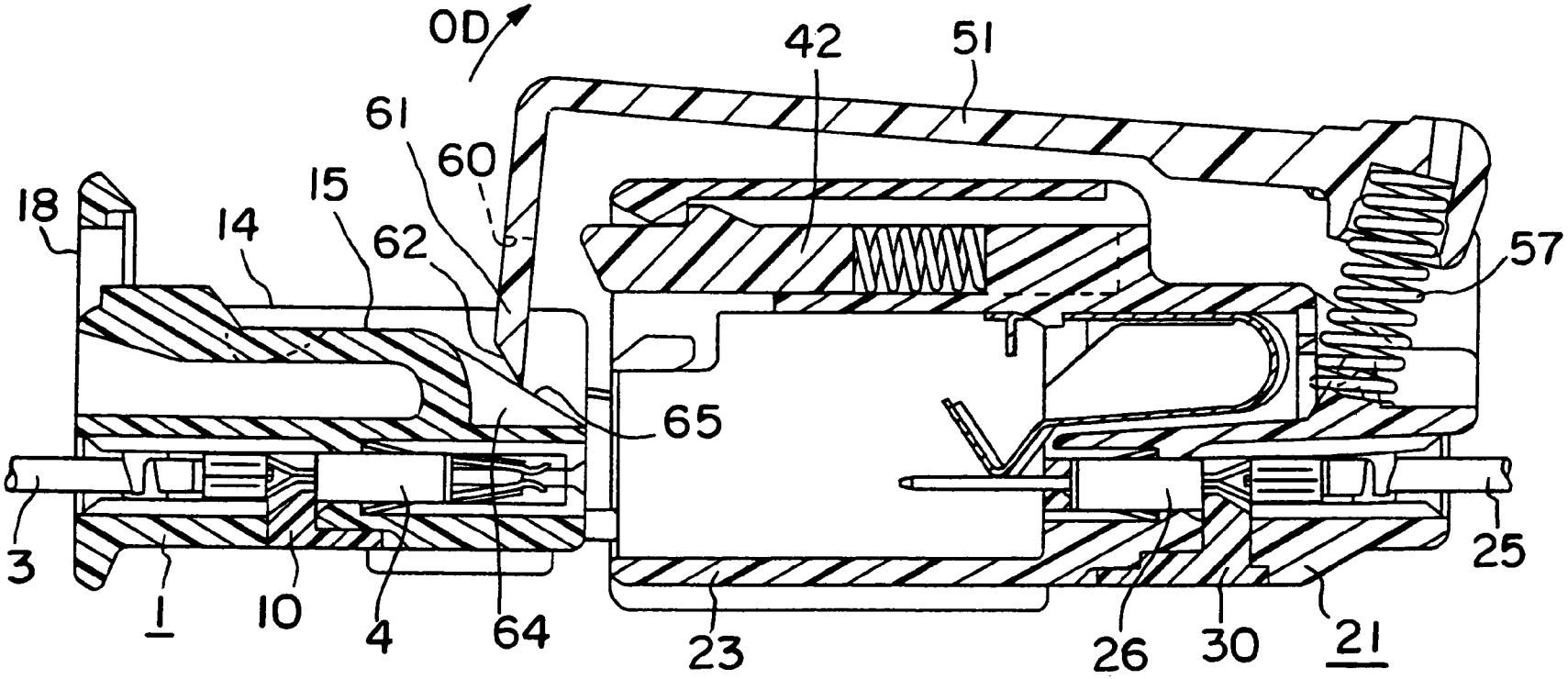
FIG. 4 is a vertical section of the embodiment when a cover is opened by a push-up plate.

A connecting operation is described here. The female housing 1 is fitted into the male housing 21 while the protection walls 14 of the female housing 1 are substantially inserted through the escape grooves 60 in the front surface of the cover 51. The cover 51 is opened slightly upward in an opening direction OD along the tapered surface 62 against the elastic force of the biasing spring 57 substantially by the tapered surface 62 of the pushed-up portion 61 of the cover 51 being brought into contact with the front edge of the upper surface of the female housing 1. When the female housing 1 is further inserted into the male housing 21, the pushed-up portion 61, in particular its tapered surface 62 is moved onto the guide surface 65 of the push-up plate 64 of the female housing 1 as shown in FIG. 4, and the cover 51 is opened further upward along the inclination of the guide surface 65. Thereafter, the pushed-up portion 61 is transferred onto the base end of the lock arm 15, continuing the connecting operation. During this time, the front end of the female housing 1 is substantially fitted into or mated with the receptacle 23 of the male housing 21.

Figure 5:
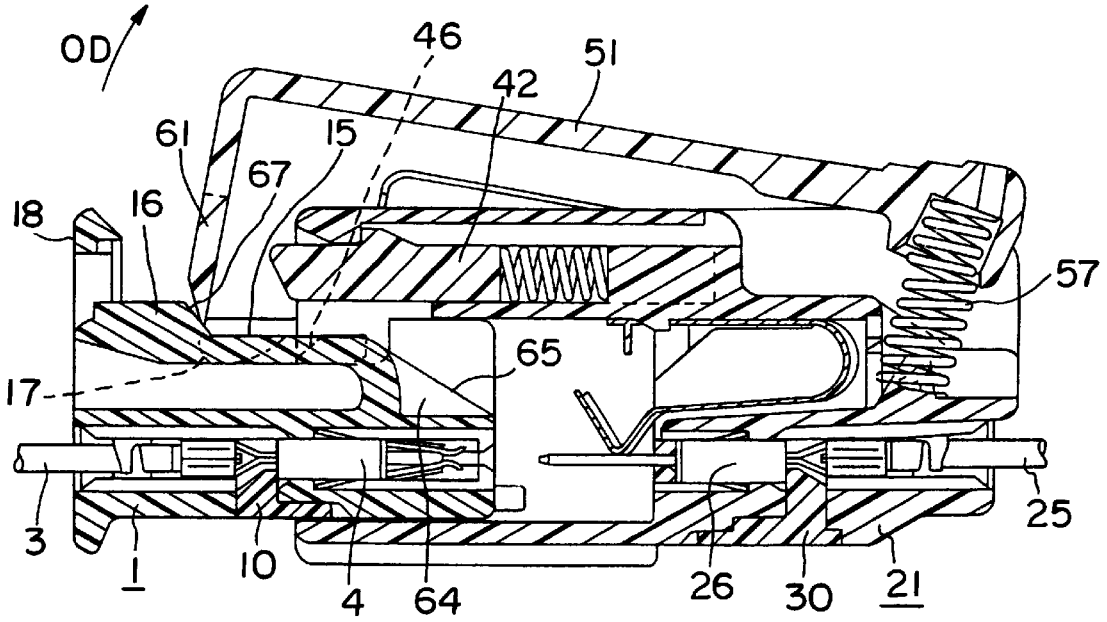
FIG. 5 is a vertical section of the embodiment while the cover is transferred onto a push-in portion of a lock arm.
Figure 6:
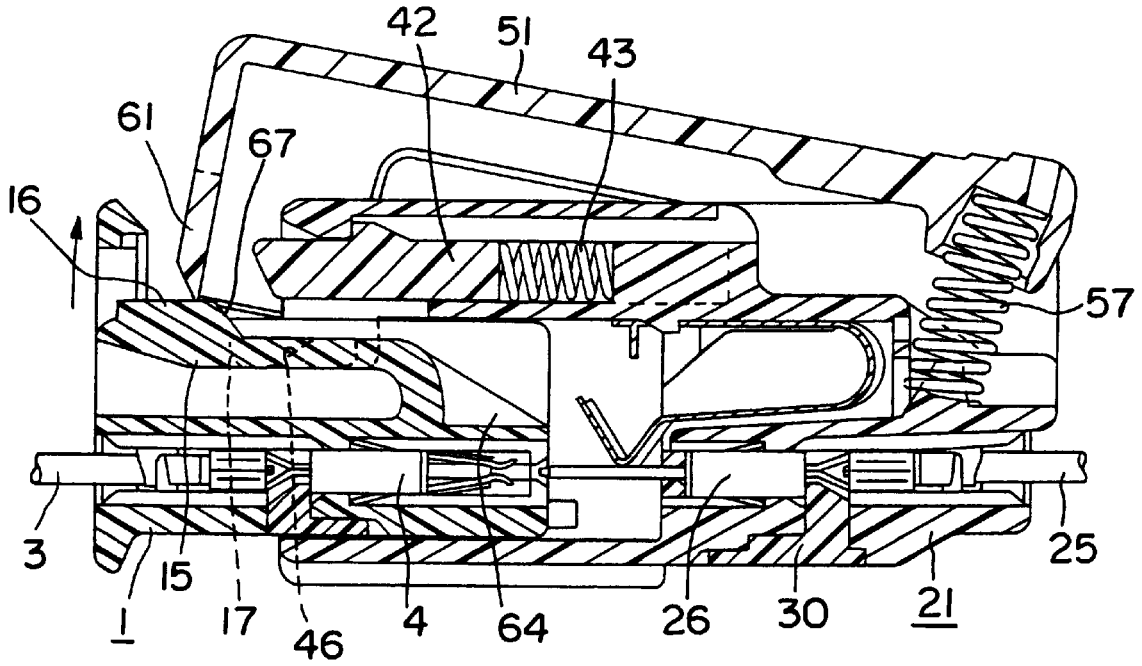
FIG. 6 is a vertical section of the embodiment when the cover is moved onto the push-in portion of the lock arm.

When the female housing 1 is further inserted, the bottom edge of the pushed-up portion 61 is preferably brought into contact with the tapered pushing surface 67 of the push-in portion 16 of the lock arm 15 as shown in FIG. 5, and the cover 51 preferably is opened upward again along the pushing surface 67, and the pushed-up portion 61 is moved onto the upper surface of the push-in portion 16. Thereafter, as shown in FIG. 6, the lock projections 17 of the lock arm 15 are brought into contact with and then moved onto the locking projections 46 provided in the male housing 21. Thereby, the lock arm 15 gradually is deformed elastically upward as shown by an arrow of FIG. 6, and the cover 51 is opened further upwardly as the pushed-up portion 61 is slid substantially over the upper surface of the push-in portion 16 (see FIG. 7).

During this time, the push-in portion 16 pushes the pushed-in member 42 against the elastic forces of the return springs 43. Accordingly, if the connecting operation is interrupted while the pushed-in member 42 is being pushed, the female housing 1 is pushed out since the elastic restoring force of the return spring 43 acts on the lock arm 15 in a returning direction. This prevents the housings 1, 21 from being left partly connected.

Figure 7:
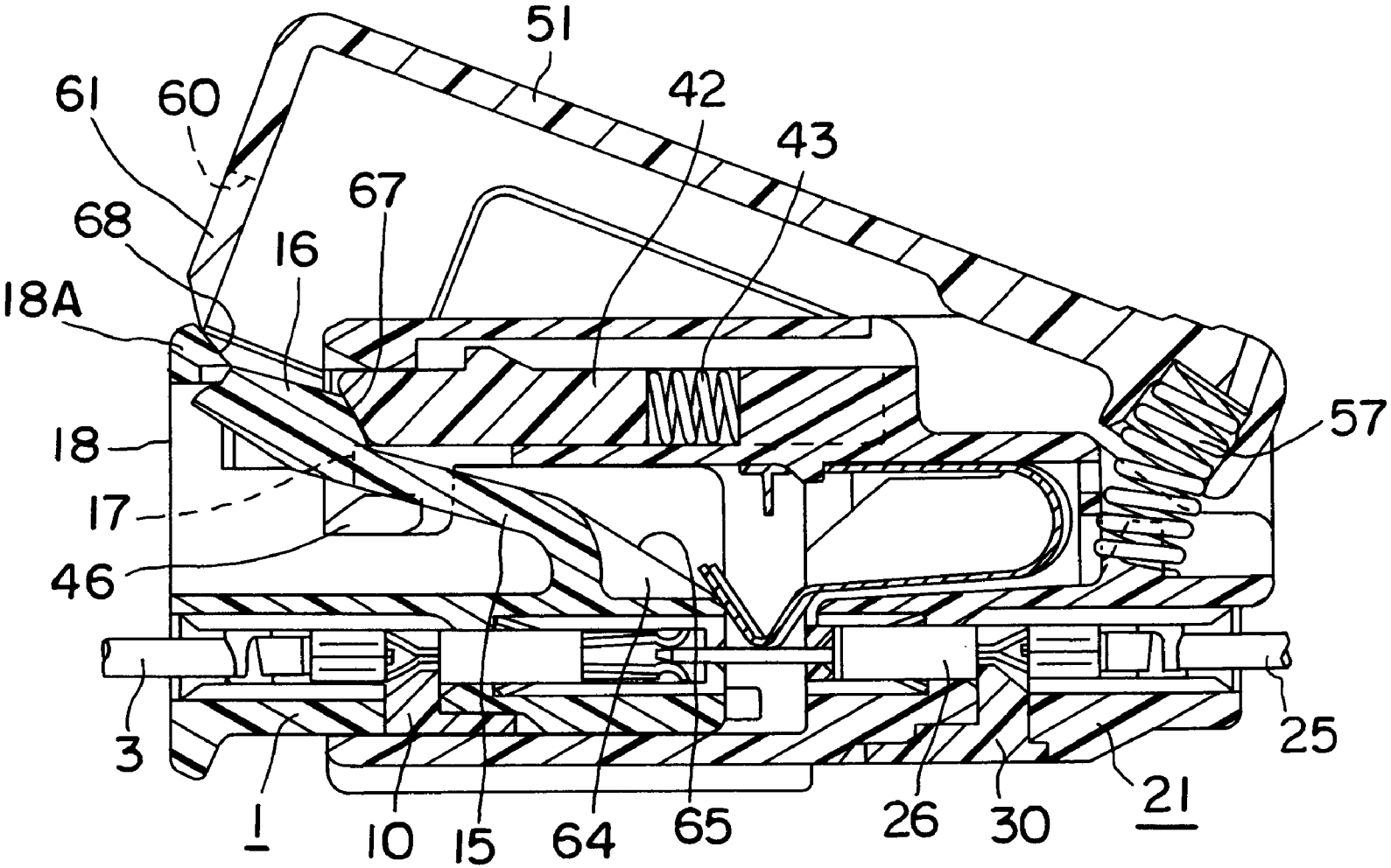
FIG. 7 is a vertical section of the embodiment when the cover is moved onto upper beams of a jam preventing frame.

When the female housing 1 is further inserted, the lock projections 17 completely move onto the locking projections 46 as shown in FIG. 7 and the lock arm 15 is elastically deformed preferably to its maximum degree. In this state, since the rear end of the push-in portion 16 is lifted to a position immediately before the upper beams 18A of the jam preventing frame 18, the pushed-up portion 61 substantially comes into contact with the tapered surfaces 68 of the upper beams 18A after passing the upper surface of the push-in portion 16. When the female housing 1 is inserted further inserted, the pushed-up portion 61 is moved onto the upper beams 18A along the tapered surfaces 68, with the result that the cover 51 is opened further.

Figure 8:
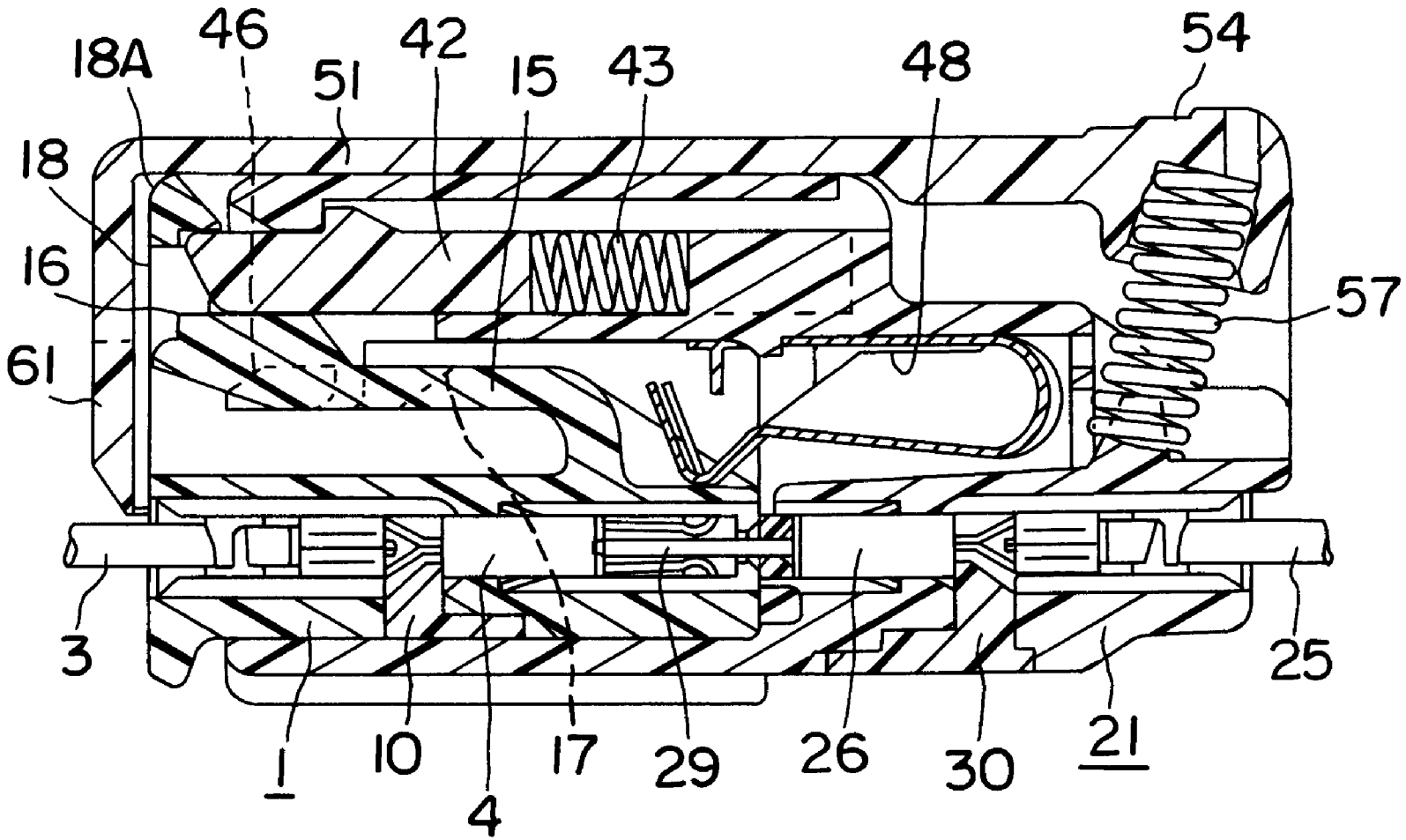
FIG. 8 is a vertical section of the embodiment when the two housings are properly connected and the cover is closed.

When the housings 1, 21 are properly connected, the lock projections 17 are located beyond the locking projections 46. Accordingly, the lock arm 15 is restored to its original shape and the lock projections 17 are engaged with the rear surfaces of the locking projections 46 as shown in FIG. 8. As a result, the housings 1, 21 are locked in their properly connected state, and the pushed-in member 42 is returned to its forward position by the elastic restoring force of the return spring 43. At this time, since the front surface of the cover 51 including the pushed-up portion 61 is moved beyond the jam preventing frame 18, the cover 51 is substantially closed by the elastic force of the biasing spring 57 and substantially closes the front side of the lock portions of the housings 1, 21 together with the jam preventing frame 18.

In the case that the housings 1, 21 are disconnected for a maintenance or other purpose, the housings 1, 21 may be separated from each other by pushing the operable portion 54 in the state of FIG. 8 to manually open the cover 51 and elastically deforming the lock arm 15 downward to effect unlocking.

As described above, according to this embodiment, the housings 1, 21 can be connected while the cover 51 is automatically opened substantially during the entire connecting or mating operation in the cover-equipped connector provided with the frame 18 for preventing the jamming of the wires.

The present invention is not limited to the described and illustrated embodiment, but the following embodiments are also embraced by the technical scope of the present invention as defined in the claims. Besides the following embodiments, a variety of other changes can be made without departing from the scope and spirit of the invention as defined in the claims.

The present invention is also applicable to connectors not provided with a shorting terminal.

The present invention is also applicable to connectors in which the lock arm and the cover are provided on the male and female connectors, respectively, converse to the arrangement of the foregoing embodiment.

What is claimed is:

1. A cover-equipped connector comprising:

a first housing having a front end with a receptacle formed therein;

a second housing configured for connection in the receptacle of the first housing;

a first locking mechanism formed in the receptacle of the first housing for locking the housings in their connected state;

a cover openably and closably provided on the first housing and extending across the front end of the first housing for substantially covering at least portions of the receptacle having the first locking mechanism;

an elastic member integrally formed on the second housing and being elastically deformable as the housings are connected, the elastic member comprising at least one opening portion disposed for engaging the cover and configured for gradually displacing the cover in an opening direction.

2. A cover-equipped connector according to claim 1, wherein the locking mechanism comprises at least one locking projection provided on the first housing for interacting with the elastic member to deform the plastic member in the opening direction of the cover when the first and second housings are mated.

3. A cover-equipped connector according to claim 1, wherein the elastic member comprises a second locking mechanism configured for releasable locked engagement with the first locking mechanism.

4. A cover-equipped connector comprising:

first and second housings to be connected with each other;

a locking mechanism for locking the housing in their connected state;

a cover openably and closably provided on the first housing for substantially covering the locking mechanism, the second housing being provided with an elastic member which is elastically deformable as the two housings are connected, the elastic member comprising at least one opening portion for engaging the cover to substantially displace it in an opening direction, a jam preventing portion for preventing wires from getting jammed by the elastic member, the jam preventing portion being formed on the second housing and wherein the cover is openable to a position where it is beyond the jam preventing portion when the elastic member is elastically deformed.

5. A cover-equipped connector according to claim 4, wherein a portion of the elastic member comes into contact with the jam preventing portion when it is deflected substantially to its maximum extent.

6. A cover-equipped connector according to claim 5, wherein the jam preventing portion is provided with a tapered portion for further guiding the cover in the opening direction upon the mating of the first and second housings.

7. A cover-equipped connector comprising:

first and second housings to be connected with each other;

a locking mechanism for locking the housings in their connected state;

a cover openably and closably provided on the first housing for substantially covering the locking mechanism, the second housing being provided with an elastic member which is elastically deformable as the two housings are connected, the elastic member comprising at least one opening portion for engaging the cover to substantially displace it in an opening direction, the opening portion comprising a push-up portion for engaging the cover at an initial stage of the connection of the housings, thereby opening the cover in the opening direction so that the cover can be transferred onto the elastic member, the push-up portion being provided in a front position of the elastic member provided on the second housing.

8. A cover-equipped connector according to claim 1, further comprising a rejecting means for disconnecting the housings when they are substantially insufficiently mated.

9. A cover-equipped connector according to claim 8, wherein the rejecting means comprises a push-in member which is pushed into the housing by the elastic member substantially upon the mating of the housings.

10. A cover-equipped connector comprising:

first and second housings to be connected with each other;

a locking mechanism for locking the housing in their connected state;

a cover openably and closably provided on the first housing for substantially covering the locking mechanism, the second housing being provided with an elastic member which is elastically deformable as the two housings are connected, the elastic member comprising at least one opening portion for engaging the cover to substantially displace it in an opening direction, the cover comprising a pushed-up portion which is pushed up by the elastic member the pushed-up portion comprising at least one tapered portion.

11. A cover-equipped connector according to claim 1, further comprising a spring between the cover and the first housing for urging the cover in a closing direction.

12. A cover-equipped connector according to claim 1, wherein the first housing has a pair of opposing sidewalls, a top wall and a bottom wall extending rearwardly from the front end of the first housing, the cover including a front wall which, in a closed condition of the cover, extends substantially between the sidewalls of the first housing and from the top wall toward the bottom wall thereof for substantially covering at least the portions of the receptacle having the first locking mechanism.

13. A cover-equipped connector according to claim 12, wherein the front wall of the cover includes a bottom edge defining a tapered surface configured for cooperating with the elastic member for urging the cover against the biasing force of the spring and in the opening direction.

14. A cover-equipped connector according to claim 13, wherein the cover includes sidewall portions adjacent the front wall thereof and extending adjacent to the sidewalls of the first housing when the cover is in the closed condition.

15. A cover-equipped connector according to claim 13, wherein the elastic member includes at least one inclined surface configured for engaging the tapered surface of the front wall of the cover for urging the cover in the opening direction and against the biasing force of the spring.

16. A cover-equipped connector according to claim 2, wherein the second housing is configured for connection in the receptacle of the first housing by moving the housings along a mating direction, the elastic member comprising at least one lock projection extending transversely on the elastic member, the lock projection on the elastic member being disposed and configured for engaging the lock projection on the first housing, at least one of the lock projection on the first housing and the lock projection on the elastic member being configured for deforming the elastic member in the opening direction of the cover when the first and second housings are mated along the mating direction.

17. A cover-equipped connector according to claim 16, wherein the lock projections each have a ramped face aligned at an acute angle to the mating direction for urging the elastic member in the opening direction of the cover.

* * * * *